United States Patent [19]

Miller et al.

[11] Patent Number: 4,588,221

[45] Date of Patent: May 13, 1986

[54] SEGMENTED DOOR OPENER

[75] Inventors: Cardell E. Miller, Hudson; Gene A. Tracy, Amery, both of Wis.; George L. Engstrom, Minneapolis; John Thorson, Roseville, both of Minn.

[73] Assignee: Ideal Security Hardware Corporation, St. Paul, Minn.

[21] Appl. No.: 748,704

[22] Filed: Jun. 25, 1985

Related U.S. Application Data

[63] Continuation of Ser. No. 474,550, Mar. 11, 1983, abandoned.

[51] Int. Cl.[4] ..... E05B 3/00

[52] U.S. Cl. ..... 292/348; 292/349; 292/353; 292/355; 292/DIG. 38; 292/DIG. 53

[58] Field of Search ..... 292/347–349, 292/353, 355–357, 336.3, DIG. 38, 169.22, 357, DIG. 53

[56] References Cited

U.S. PATENT DOCUMENTS

| | | | |
|---|---|---|---|
| 348,656 | 9/1886 | Briggs | 292/169.22 |
| 1,653,514 | 12/1927 | Schlage | 292/348 X |
| 3,096,115 | 7/1963 | Patriquin et al. | 292/347 |
| 3,602,539 | 8/1971 | James | 292/353 |
| 4,062,579 | 12/1977 | Potter et al. | 292/348 |
| 4,161,891 | 7/1979 | Bossert | 292/348 X |
| 4,189,248 | 2/1980 | Sully | 292/353 X |

OTHER PUBLICATIONS

*Popular Science,* Feb. 1949, p. 128, "Spring Action Holds This Doorknob Fast".

*Primary Examiner*—Robert L. Wolfe
*Assistant Examiner*—Lloyd A. Gall
*Attorney, Agent, or Firm*—Merchant, Gould, Smith, Edell, Welter & Schmidt

[57] ABSTRACT

The subject of this patent application is a door assembly (10) having a knob (38) which, during shipment, is segregated from the rest of the assembly (10) for ease in packaging and storage. The invention includes a unique locking element (62) for securing the knob (38) to the door closure panel (12) when the panel (12) is at a location at which it is to be installed.

7 Claims, 12 Drawing Figures

SEGMENTED DOOR OPENER

This is a continuation of application Ser. No. 474,550, filed Mar. 11, 1983 now abandoned.

TECHNICAL FIELD

The invention of the present patent application is broadly concerned with the field of door closure structures. More narrowly, however, it is directed to a door closure assembly with emphasis upon its disassembled nature allowing it to be more readily packaged for shipping to the destination at which it will be ultimately installed. Specific embodiments and structures of the invention deal with a feature whereby a knob element, separate from the door closure panel itself, is securely mated to the door panel for subsequent operation as if the knob had been formed integrally with the panel.

BACKGROUND OF THE INVENTION

Door closure panels are used in all kinds of buildings including, specifically, residential dwellings. Such panels may be of a number of types. In many applications, such as patio and deck doors, the panels are slidably mounted wherein a movable panel can be slid in a plane, parallel to the wall of the building in which it is mounted, for opening and closing. A track on which the panel can slide between opened and closed positions is provided.

Another manner in which door closure panels are mounted is one wherein the panel is hingedly mounted at one edge thereof to a side of the opening in which it is to be installed. In most residential dwellings, this type of structure is utilized for doors adjoining adjacent rooms and main entryway doors.

In most homes, the main doors affording ingress to and egress from the building are provided with a second door known as a storm door. Such doors are typically of metal construction, frequently being manufactured from aluminum. Glass panels (frequently unbreakable glass, as now required by statute in many states) are held within the metal frame in order not to obstruct the view of a person inside the house.

Storm doors serve a number of purposes. Most significantly, they serve an insulative function. During the winter, an insulative air pocket is developed between the main door closure and the storm door. While main entry doors frequently do not have particularly close tolerances relative to the frame in which they are mounted, storm doors are mounted with close tolerances in order to facilitate the development of the air pocket and to preclude drafts which might arise because of air flow outside the house or because of pressure differentials between the air inside and outside the house.

As can be seen, therefore, storm doors serve an extremely important function, particularly in geographic locations subject to severe winters. Such doors are manufactured by a number of concerns and are, typically, constructed as an integral unit for shipment to locations at which they are sold on a retail level.

By so manufacturing such doors, certain problems are presented with respect to shipment of the units for distribution and sale. As is apparent, manufacturers of storm doors are required to devise packaging for relatively large components. The protrusion of the knob for the door, however, presents problems of an even more aggravating nature. Not only does its protrusion require unique and distinctive packaging, but it also allows the possibility of damage to or breakage of the knob.

The invention of the present application provides a structure which solves the problems in the prior art. The invention of this patent application is a door assembly which minimizes the chances of damage or breakage occuring to the knob.

SUMMARY OF THE INVENTION

The invention of this application is a door assembly which is specifically configured with the goal of preventing breakage or damage to the knob. Additionally, it facilitates the easy formation of packaging in which the storm door can be shipped during distribution. The assembly includes a closure panel. As with other doors, the panel includes a bolt which is housed within the panel and disposed for sliding reciprocal movement into and out of an aperture formed in the edge of the panel. Such a bolt cooperates with the frame in which the door is mounted to hold the door in a closed position or, when desired, to release the door to allow opening. The bolt is typically (as in this case) operated by a spindle extending generally transversely to the direction in which the bolt reciprocates and through a second aperture formed in a face or opposite faces of the panel. Means are included for converting rotational motion imparted to the spindle into the linear reciprocating movement of the bolt. A knob, separate from the door panel, is also provided. During shipping, the knob is detached from the panel and can be mated with the spindle after the door is installed at its ultimate location at which it is to be used. When the door is installed, the knob can be attached thereto and mated with the spindle in order to effect rotation thereof.

In a preferred embodiment, means for securing the knob in a configuration mated to the spindle can include a locking element held to the door panel by an escutcheon and extending through an aperture in the escutcheon, as does the spindle. The locking element can include a plurality of prongs spaced at equal angular distances from one another. Each prong can be provided, at an end remote from the escutcheon, with a barb extending generally radially outwardly to define a shoulder facing the escutcheon. The knob element can be provided with an annular lip defining a shoulder engageable with the shoulders of each of the prongs.

The prongs can define a diameter slightly larger than the inside diameter of the annular lip of the knob. Outer surfaces of the prongs can be provided with ramp surfaces so that, as the element enters the knob within the lip, the prongs will be urged inwardly. As the barbs pass the annular lip of the knob, the prongs will be allowed to snap outwardly in order to permit the barb shoulders to engage the annular shoulder of the knob to preclude withdrawal of the knob.

Because of the conspicuous location at which many storm doors are mounted, many owners wish that they, in some manner, be decorative. To this end, the knob can be provided with a removable face plate which can be replaced with a plate to the liking of the owner. A custom designed face plate might even be attached to the knob.

The invention of the present application is, thus, a door assembly which is designed not only to solve many of the problems in the prior art with regard to packaging and shipping, but which also includes structure whereby a knob member of the assembly can be selectively configurable in accordance with the aesthetic tastes of the owner. More specific structural features, and advantages obtained in view of those features, will become apparent with reference to the detailed description of the invention, appended claims, and drawing figures.

DETAILED DESCRIPTION OF THE INVENTION

Figure 1:
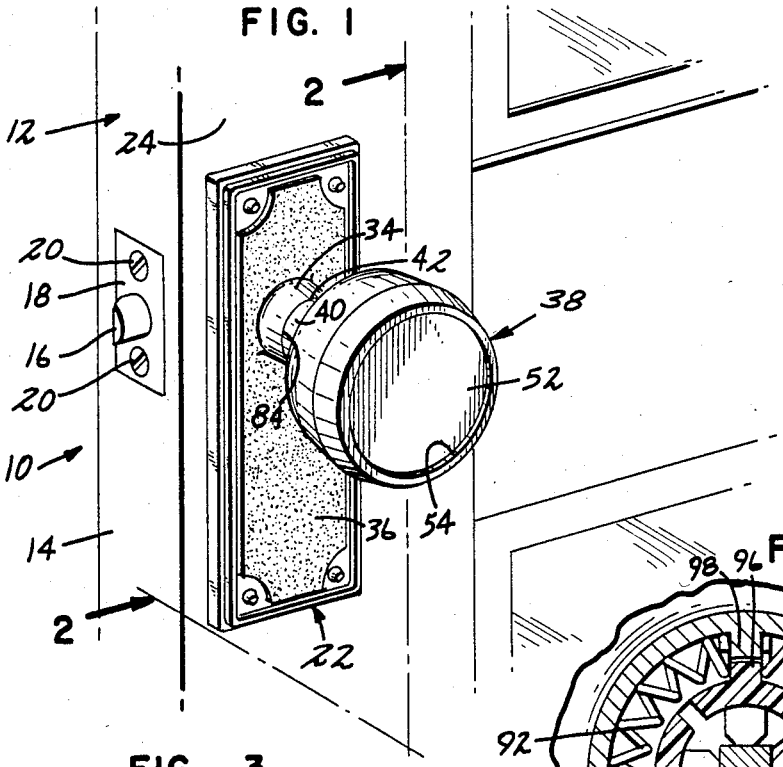
FIG. 1 is a perspective view of a portion of a storm door including the inventive features of the present application.

Referring now to the drawings, wherein like reference numerals denote like elements throughout the several views, and particularly to FIG. 1, a door assembly 10 which would be typically mounted to effect selective closure of an aperture formed in the wall of a building is illustrated. The assembly 10 incorporates the invention of the present application, and FIG. 1 might, therefore, illustrate a portion of a door known as a storm door. It will be understood, however, that the present invention is not for use exclusively in storm doors.

The door assembly 10 includes a closure panel 12 which can be mounted for pivoting into and out of the aperture in the wall about a generally vertically extending axis. Appropriate means such as hinges, not shown, can be utilized in order to accomplish this mounting.

At an edge 14 of the door 12 opposite the edge by which it is pivotally mounted, such a door 12 typically has means for latching the door in a closed position. Such latching means usually includes a bolt 16 slidably disposed for lateral movement into and out of the edge 14 of the door 12 opposite that edge by which it is pivotally mounted. When the bolt 16 is extending out of the edge 14, it can be received into an aperture formed in a receiving member (not shown) mounted to the door jamb. A plate 18 can be affixed to the edge 14 of the door 12 surrounding and/or defining the aperture through which the bolt 16 moves in order to strengthen the bolt 16 in its relationship relative to the closure panel 12. The plate 18 can be affixed to the edge 14 of the panel 12 by appropriate means such as screws 20.

Figure 2:
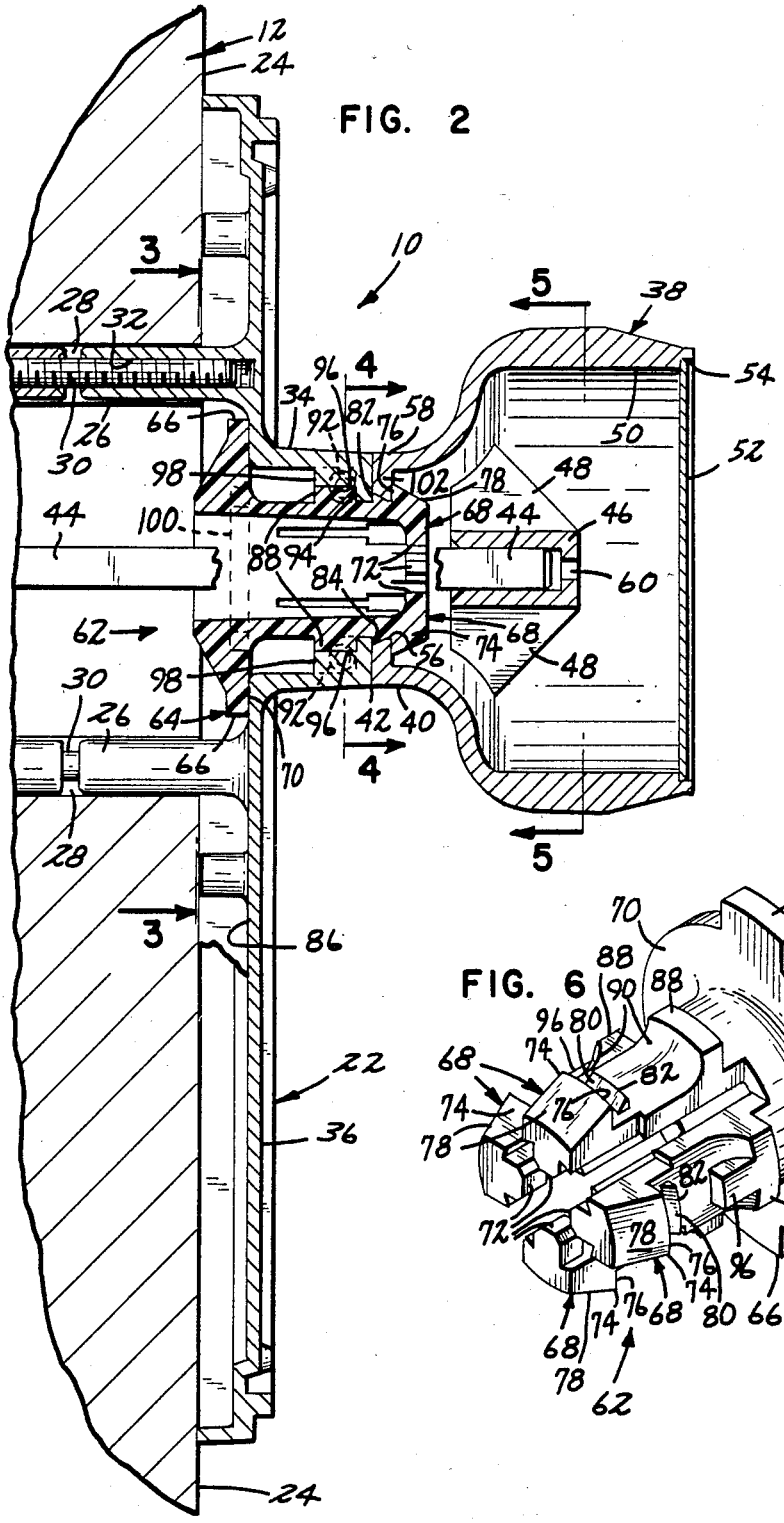
FIG. 2. is a vertical section taken along the line 2—2 of FIG. 1.

An escutcheon 22 is shown as mounted on one face 24 of the door 12 closely proximate the edge 14 from which the bolt 16 exits. As best seen in FIG. 2, the escutcheon 22 can be secured to the panel 12 and maintained in a fixed orientation by means of a plurality of bosses 26 received, when the escutcheon 22 is attached to the face 24 of the door 12, in holes 28 drilled in the panel 12. Screws or bolts 30 can be inserted through the holes 28 through an opposite face of the panel 12 and into internally threaded bores 32 formed in the bosses 26.

FIG. 1 illustrates a knob stem portion 34 integrally formed with the escutcheon 22 and extending from a platen 36 portion of the escutcheon 22 in a direction away from the closure panel 12. A knob 38, separate from the escutcheon panel 36 is shown with a narrowed neck portion 40 thereof abutting the stem portion 34 along a line of engagement 42. The knob 38, during shipment of the door assembly 10, is segregated from the rest of the assembly and is affixed thereto only when the door is to be installed in the aperture in the wall of a building.

When the knob 38 is mated to the rest of the door assembly, it cooperates with a smooth spindle 44, mounted so that it extends through the stem portion 34 of the escutcheon 22 and an aperture in the face of the door 12 which the stem portion 34 overlies, in order to effect lateral movement of the bolt 16 when such movement is desired in order to open the door. Turning of the knob 38 can be translated into rotation of the spindle 44 by providing the spindle 44 with an externally faceted surface receivable in a similarly internally faceted socket 46 carried within the knob 38. The socket 46 can be held in position to receive the spindle by a plurality of radially extending struts 48 engaging the inner wall 50 of the knob 38. Rotation of the spindle 44 can, in turn, effect lateral movement of the bolt 16 by use of mechanical linkages known in the art.

The knob 38 can be provided, at its end, remote from the closure panel, with a disc 52 seated and held within a recess 54. The disc 52, normally provided with the door assembly, can be plain and non-ornamental. It can be held within the recess 54 in any appropriate manner. It will be understood, however, that, should the purchaser of the assembly so wish, the disc 52 can be removed, prior to the mating of the knob 38 to the door assembly 10 in a manner hereinafter defined, by inserting any narrow, elongated tool through a hole 56 formed in the base 58 of the knob 38, into the socket 46, and through a small orifice 60 in the base of the socket 46 into engagement with the disc 52. By applying sufficient pressure, the disc 52 can be popped out of the recess 54 and replaced with an ornamentally designed disc havig similar dimensions.

Figure 6:
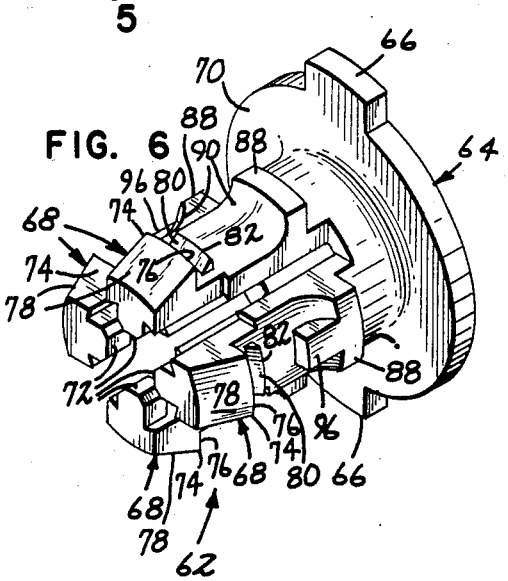
FIG. 6 is a perspective view of the locking element whereby the knob is secured to the door panel.
Figure 7:
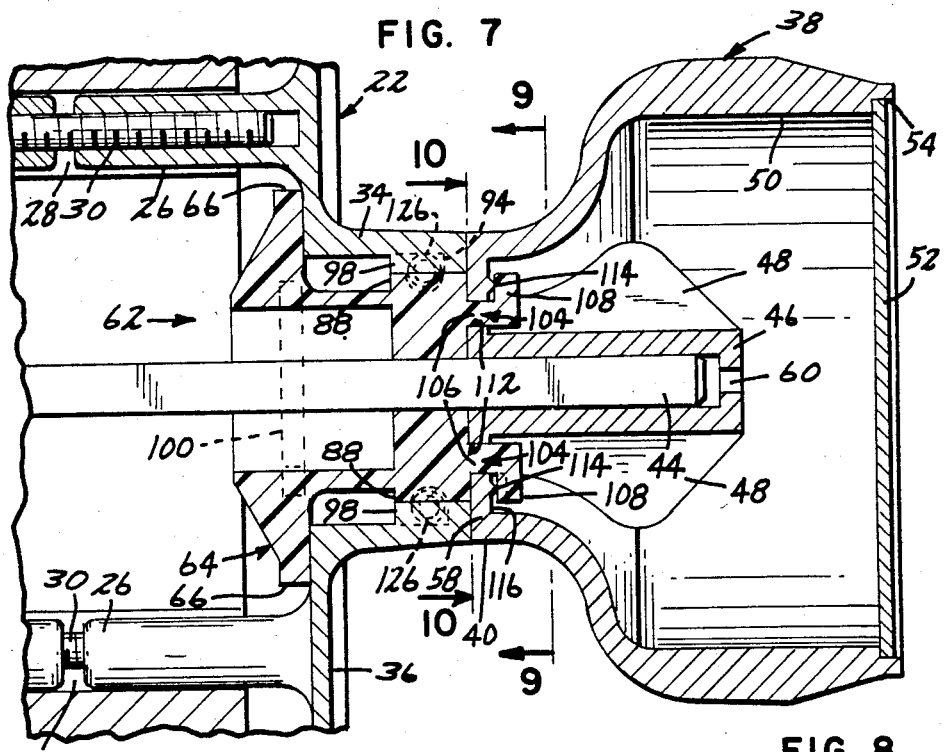
FIG. 7 is a vertical section taken along line 2—2, but of an alternative embodiment to that shown in FIG. 2.
Figure 11:
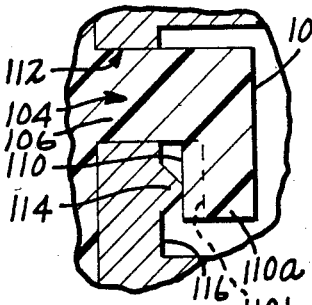
FIG. 11 is an enlarged view of an area shown on FIG. 7, showing a protruding member and the adjacent area.
Figure 12:
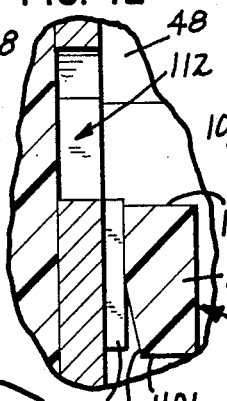
FIG. 12 is a view taken generally along line 12—12 of FIG. 9.

The invention includes means for securing the knob 38 to the closure panel with the neck 40 of the knob 38 in engagement with the knob stem portion 34 of the escutcheon 22. Such mating can be effected by means of a locking element 62 held to the closure panel 12 by the escutcheon 22. The locking element 62 is best illustrated in FIG. 6. It includes a base portion 64 having, as illustrated in that figure, a pair of diametrically opposed extension members 66 extending radially therefrom.

A plurality of equi-angularly spaced prongs 68 extend axially from one face 70 of the base portion 64. FIG. 6 illustrates four such prongs 68, each being spaced 90° from adjacent of the prongs 68.

The prongs 68 are resilient in nature allowing them to deform radially for a purpose discussed hereinafter. Radially inwardly facing surfaces 72 of the prongs 68 can be faceted in a manner similar to the faceting of the knob socket 46 in order to allow the spindle 44 to pass therebetween with the faceted surface of the spindle in engagement with faceted surfaces of the prongs 68.

The radially outwardly surface of each prong can include, at an end remote, when the locking element 62 is held by the escutcheon 22, from the escutcheon 22, a radially outwardly extending barb 74. The barb 74 can define a shoulder 76 facing axially toward the escutcheon 22. A surface 78 of the barb 74 facing obliquely in a direction away from the direction in which the shoulder 76 faces can be ramped so that, when the knob 38 is inserted onto the locking element 62 as hereinafter discussed, the prongs 68 will deform radially inwardly until the barbs 74 pass the base 58 of the knob 38.

Spaced axially on each prong 68 from the barb 74 in a direction toward the base 64 of the element 62 is a locking nub 80. The nub 80 is configured similarly to the barb 74, but is somewhat smaller in dimensions. An axially facing surface 82 of the nub 80 is generally parallel to a surface of the base 64 of the locking element 62, and the nub 80 is spaced from the base 64 so that, when the locking element 62 is inserted through the aperture in the escutcheon 22 from a back side thereof, the surfaces 82 of the nubs 80 will engage an outwardly facing surface 84 of the knob stem portion 34 of the escutcheon 22 while the base 64 of the locking element 62 engages an inner surface 86 of the platen portion 36 of the escutcheon 22. The base portion 64 of the locking element 62 and the nubs 80 can, thereby, cooperate to secure the locking element 62 to the escutcheon 22.

Figure 4:
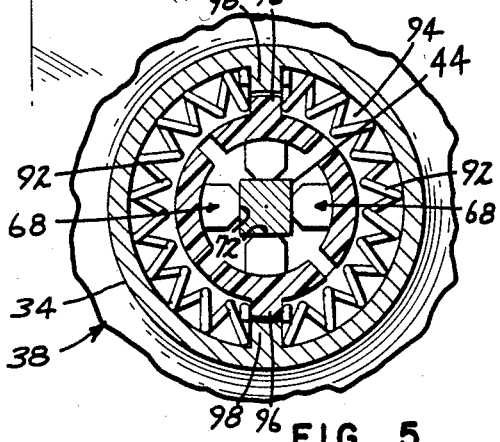
FIG. 4 is a view taken generally along the line 4—4 of FIG. 2.

Each prong 68 can be provided with a tab 88 radially intermediate the base 64 of the locking element 62 and the nub 80, by the assistance of which the element 62 can be secured to the escutcheon 22. Each tab 88 can have a contoured surface 90 facing in an axially direction away from the base 64 of the locking element 64. These contoured surfaces 90 can, together, support a pair of springs 92 between the surfaces 90 and an axially facing surface 94 of the knob stem portion 34 of the escutcheon 22. Two opposite tabs 88 can be provided with radial extensions 96 received between ends of the springs 92. As the knob 38, and, in turn, the locking element 62, is turned, the radial extensions 96 will compress the springs 92. As the knob 38 is released, the compressed springs 92 will urge the locking element 62, therefore, back to a centered position. As seen in FIG. 4, the springs 92 are held in circumferential locations by radially inwardly extending tabs 98 carried within the knob stem portion 34 of the escutcheon 22.

Figure 3:
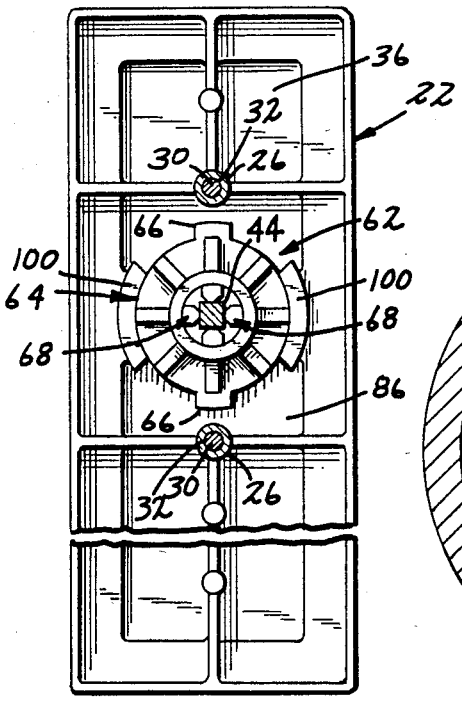
FIG. 3 is a view taken generally along the line 3—3 of FIG. 2.
Figure 5:
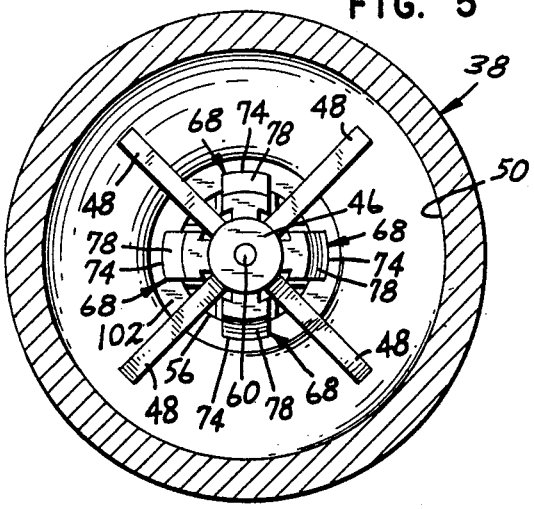
FIG. 5 is a view taken generally along the line 5—5 of FIG. 2.

For various reasons, it is desirable to limit the degree to which the knob 38 can be rotated. Since rotation of the knob 38 through approximately 45° to 60° will be sufficient to retract the bolt 16 into the aperture formed in the edge 14 of the closure panel 12, means can be provided for limiting the degree to which the knob 38 can be turned to an angular measure of a lesser degree. As seen in FIG. 3, arcuate stops 100 can be provided on the back 86 of the platen portion 36 of the escutcheon 22. These stops 100 are positioned with respect to the base 64 of the locking element 62 so that, as the locking element 62 and knob 38 are rotated, the extension 66 from the base 64 of the locking element 62 will engage these stops 100.

When the door assembly 10 described herein is at a location at which it is desired to mate the knob 38 to the rest of the assembly, the knob 38 can merely be urged so that the neck portion 40 thereof is moved into engagement with the knob stem portion 34 of the escutcheon 22. When such action is taken, the locking element 62 will be protruding somewhat through the aperture formed in the stem portion 34. Because of the ramp surfaces 78 provided on the barbs 74 and a similarly angled bevel formed in the base 58 of the knob 38 at the extremity of the hole 56, as the knob 38 is moved into position, the prongs 68 will be urged radially inwardly until the knob 38 is in engagement with the knob stem portion 34. At that positioning, the prongs 68 will be allowed to snap radially outwardly since the barbs 74 will have passed the base 58 of the knob 38. The axially facing shoulders 76 of the barbs 74 will then be in engagement with an annular, axially facing shoulder defined by the base 58 of the knob 38 preventing displacement of the knob in both axial directions relative to the escutcheon. Since a diameter defined by the outermost extremities of the barbs 74 is larger than an inner diameter of the hole 56 defined by the base 58 of the knob 38, retraction of the knob 38 will be precluded.

The base can be provided with a radially inwardly extending wall portion 102 having a plurality of keyways formed therein. The keyways can correspond in number, shape, and location to the prongs 68 of the locking element 62. When the knob 38 has been mated with the knob stem portion 34 of the escutcheon 22, the prongs 68 can be seated, circumferentially, within these keyways so that, as the knob 38 is rotated, the locking element 62 will be rotated correspondingly. By limiting the degree of rotatability of the locking element 62, therefore, the degree of rotatability of the knob 38 can also be limited.

An alternative embodiment of the segmented door opener, particularly the locking element, is shown in FIGS. 7–12. In this embodiment, the locking element 62 having base portion 64 with extension members 66, has a plurality of L-shaped protruding members 104. Preferably, the locking element has two pairs of protruding members, each member spaced radially 90° from another member.

Each protruding member 104 has a shaft 106 and a head 108, the head being directed outwardly at approximately 90° from the shaft. The surface of the head which generally faces base 64 of locking element 62, includes an angled or sloped surface 110, as seen in FIG. 8.

The base 58 of knob 38 is provided with L-shaped openings 112. The openings 112 include both a larger portion **112*a* which is of a size to receive head 108, and a smaller portion 112*b* which is of a size to receive shaft 106. To connect knob 38 to locking element 62, the heads 108 of the protruding members 104 are passed into the larger portion 112*a* of the openings 112. Then the locking element 62 is rotated with respect to knob 38 such that the shafts pass into the smaller portions 112*b* of the L-shaped openings 112**, and the heads are spaced laterally from the portion of the openings through which they entered.

A ridge 114 is provided on the interior surface 116 or knob 38, that surface which faces the sloping surface 110 of the head 108 of each protruding member 104. When locking element 62 is rotated as previously described to engage the knob 38, the wider end **110*a* of the sloping surface 110 contacts and remains in contact with the ridge 114**, for more advantageous holding between the locking element and the knob.

Figure 8:
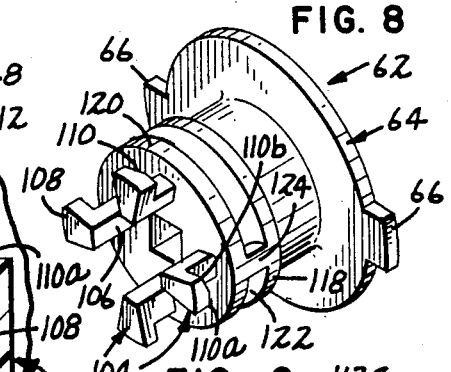
FIG. 8 is a perspective view of an alternative embodiment of the locking element whereby the knob is secured to the door panel.
Figure 10:
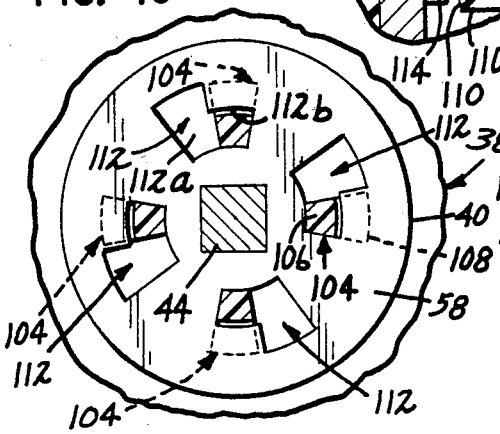
FIG. 10 is a view taken generally along line 10—10 of FIG. 7.
Figure 9:
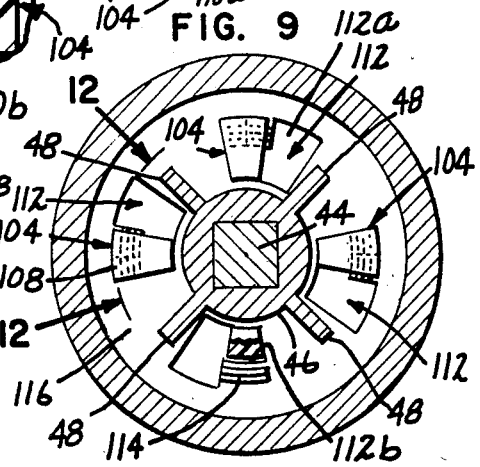
FIG. 9 is a view taken generally along line 9—9 of FIG. 7.

As seen in FIG. 8, extending from base 64 of locking element 62 is a neck portion 118. The neck portion includes a pair of circumferentially extending recesses 120 and 122. The recesses are separated from each other by two barriers 124 (one not shown), located opposite each other. As similarly described for the first embodiment, a pair of springs 126 are supported by recesses 120 and 122 and by axially facing surface 94 of knob stem portion 34 of escutcheon 22. Carried within knob stem portion 34 of escutcheon 22 are radially extending tabs 98 which are located between the ends of the springs, as are barriers 124. As knob 38, carrying locking element 62, is turned, for example, to open the door, the barriers 124 will compress the springs 126. As knob 38 is released, the compressed springs will urge the locking element and knob back to the original position.

Numerous characteristics and advantages of the invention have been set forth in the foregoing description. It will be understood that this disclosure is, in many respects, only illustrative. Changes may be made in details, particularly in matters of shape, size, and arrangement of parts without exceeding the scope of the invention. The invention's scope is defined in the language in which the appended claims are expressed.

What is claimed is:

1. A door assembly configured for shipping prior to its being installed at an ultimate location, comprising:

(a) a closure panel having a panel aperture formed in a face thereof;

(b) a latching apparatus carried by said panel comprising a smooth spindle extending through said panel aperture and disposed for rotation about a spindle axis thereof along which said spindle is aligned in the direction along which it extends through said panel aperture;

(c) an escutcheon, having an escutcheon aperture formed therein, applied to said face with said escutcheon aperture overlying said panel aperture;

(d) a locking element having a locking element axis and held to said panel by said escutcheon wherein said locking element is substantially coaxially aligned with said spindle, said locking element including a plurality of resilient prongs extending through said escutcheon aperture and away from said escutcheon, each of said prongs having an end remote from said escutcheon carrying a prong shoulder facing toward said escutcheon; and (e) a knob, separate from said panel, having a knob shoulder, wherein said resilient prongs of said locking element deflect radially inward to engage said knob shoulder, said knob held in fixedly secured position against said escutcheon thereby holding said knob against displacement in both axial directions relative to said escutcheon; wherein said spindle extends through said locking element to prevent further radial deflection of said resilient prongs when said assembly is completely assembled to thereby preclude removal of said knob from said locking element; wherein said escutcheon holds said locking element which in turn holds said knob so that said escutcheon bears any axial loads on said knob and so that the spindle need only transmit a torque load from the knob to the remainder of the latching apparatus; and wherein said locking element is inaccessible when said door assembly is completely assembled.

2. An assembly in accordance with claim 1, wherein said resilient prongs are equi-angularly spaced, and each of said prongs has a barb extending radially outwardly to define a shoulder facing toward said escutcheon, and wherein said knob includes an annular shoulder having an inner diameter smaller than a diameter defined by radially outermost extremities of said barbs when said prongs are in an uncompressed state, so that said prongs can be compressed radially inwardly to allow said barbs to pass through said inner diameter of said annular shoulder and, thereafter, released to allow said shoulders defined by said barbs to engage said annular shoulder of said knob.

3. An assembly in accordance with claim 2, wherein said prongs include ramp surfaces angled to urge said prongs radially inwardly as they are made to engage said inner diameter of said annular shoulder.

4. An assembly in accordance with claim 1, wherein said spindle is externally faceted, and wherein said knob includes a faceted socket in which said spindle can be received when said knob and said spindle are mated.

5. An assembly in accordance with claim 1, wherein said knob has a removable disc facing away from said escutcheon, whereby a user of said assembly can remove said disc and replace said disc with one having a design formed thereon.

6. A door latch operating mechanism for use with a door, comprising:

(a) a smooth spindle;

(b) an escutcheon overlying a portion of the door and having an aperture formed therethrough, through which aperture said spindle passes;

(c) a locking element held to the door by said escutcheon and extending through said aperture, said element including a plurality of equi-angularly spaced, resilient prongs, each having a barb extending radially outwardly from an end of said each prong remote from said escutcheon to define a shoulder facing said escutcheon;

(d) a knob having a base, a hole formed in said base, and an annular shoulder facing, when the knob is attached to the door, away from said escutcheon, wherein said shoulders of said prongs can engage said annular shoulder of said knob to irremovably secure said knob to the door; and (e) means for translating rotation of said knob into rotation of said spindle, wherein said resilient prongs of said locking element deflect radially inward to engage said knob shoulder, said knob held in fixedly secured position against said escutcheon thereby holding said knob against displacement in both axial directions relative to said escutcheon; wherein said spindle extends through said locking element to prevent further radial deflection of said resilient prongs when said assembly is completely assembled to thereby preclude removal of said knob from said locking element; wherein said escutcheon holds said locking element which in turn holds said knob so that said escutcheon bears any axial loads on said knob and so that the spindle need only transmit a torque load from the knob to the remainder of the latching apparatus; and wherein said locking element is inaccessible when said door assembly is completely assembled.

7. The door latch operating mechanism according to the claim 6, further comprising a resilient element operatively interposed between said escutcheon and said locking element, wherein said resilient element urges said locking element toward its normal centered position.

* * * * *